United States Patent [19]

Geyken et al.

[11] 3,978,506

[45] Aug. 31, 1976

[54] APPARATUS AND METHOD FOR NEUTRALIZING WASTE PHOTOGRAPHIC FLUIDS

[75] Inventors: Erwin Geyken; Franz Ertl, both of Munich, Germany

[73] Assignee: AGFA-Gevaert, A.G., Leverkusen, Germany

[22] Filed: Dec. 5, 1974

[21] Appl. No.: 530,050

[30] Foreign Application Priority Data

Dec. 7, 1973 Germany ..... 2361150

[52] U.S. Cl. ..... 354/324

[51] Int. Cl.[2] ..... G03D 3/02

[58] Field of Search ..... 354/297, 319, 320, 321, 354/322, 323, 324; 134/64 P, 109, 122 P; 210/60, 105, 127; 96/63

[56] References Cited

UNITED STATES PATENTS

| | | | |
|---|---|---|---|
| 1,319,026 | 10/1919 | Ybarrondo | 354/321 |
| 2,073,664 | 3/1937 | Weisberg et al. | 96/63 X |
| 3,528,358 | 9/1970 | Pickard | 354/323 X |
| 3,687,050 | 8/1972 | Wilke | 354/324 |
| 3,733,994 | 5/1973 | Armstrong et al. | 354/324 X |
| 3,738,868 | 6/1973 | Lancy | 210/60 X |
| 3,832,730 | 8/1974 | Geyken et al. | 354/319 X |

FOREIGN PATENTS OR APPLICATIONS

| | | | |
|---|---|---|---|
| 651,937 | 10/1937 | Germany | 210/105 |

*Primary Examiner*—Fred L. Braun
*Attorney, Agent, or Firm*—Michael J. Striker

[57] ABSTRACT

An apparatus and method for neutralizing waste film-processing fluids discharged from a plurality of work stations containing film-processing fluids utilize a container adapted to receive the waste fluids as well as a predetermined quantity of neutralizing fluid. The quantity of neutralizing fluid admitted into the container is a function of the number and/or size of the film-emulsion carriers to be processed in the work station and/or a function of the fluid content of the container itself. A sensor is provided to detect the fluid contents of the container and cooperates with a control value so as to admit the predetermined quantity of neutralizing fluid into the container. A discharge pump is also provided to discharge the neutralized fluid contents of the container to a discharge area.

19 Claims, 2 Drawing Figures

APPARATUS AND METHOD FOR NEUTRALIZING WASTE PHOTOGRAPHIC FLUIDS

BACKGROUND OF THE INVENTION

The present invention relates to an apparatus and a method for neutralizing fluids, and more particularly, to neutralizing waste photographic film-processing fluids.

In the prior art, it is known to discharge the waste fluids from each of a plurality of work stations directly into sewage lines which empty into discharge areas, such as rivers, without prior treatment. With the advent of concern for environmental protection as well as the increased economic incentive to recycle waste fluids, it is known in the prior art to collect the waste fluids in separate decontamination containers, and thereupon to treat each of the decontaminating containers separately with neutralizing fluids in separate neutralization chambers. The prior art has the drawback that it requires a complex arrangement of separate decontamination and neutralizing containers with associated conduits and valves cooperating to neutralize each film-processing fluid separately. Reaction times are generally quite lengthy since a series of containers are neutralized sequentially, thus leading to the further possibility of premature dumping of the waste fluids before complete neutralization has occurred.

Another drawback of the prior art is that the amount of neutralizing fluid to be admitted into each of the decontamination containers is not proportional to the size or length and/or quantity of the film-emulsion carriers to be processed. As a result, an insufficient amount of neutralizing fluid is admitted into each decontamination chamber. The resultant incomplete neutralization reaction would then be a source of pollution material itself, and thereby increase the pollution hazard.

SUMMARY OF THE INVENTION

Accordingly, it is a general object of the present invention to overcome the disadvantages of the prior art.

More particularly, it is an object of the present invention to provide an improved apparatus for neutralizing waste film-processing fluids by utilizing a single container which is adapted to receive waste fluids and a predetermined quantity of neutralizing fluid.

An additional object of the present invention is to neutralize the waste fluids in a simple and effective manner without a complex arrangement of numerous conduits and valves.

An additional object of the present invention is to neutralize the waste fluids in a manner requiring minimum reaction time.

A further object of the present invention is to neutralize the waste fluids so that the amount of neutralizing fluid is proportional to the size or length and/or the quantity of the film-emulsion carriers.

An additional object of the present invention is to neutralize the waste fluids so that the amount of neutralizing fluid is proportional to a predetermined volume of the fluid contents of the container.

An additional object of the present invention is to provide for a discharge only at time intervals after complete neutralization has occurred so that premature dumping of polluted material is not possible.

In keeping with these objects, and with others which will become apparent hereinafter, one feature is the utilization of a single container which is adapted to receive waste fluids from a plurality of work stations and a predetermined quantity of neutralizing fluid from a separate supply source. Since the neutralization reaction occurs in a single container, it is possible to accurately detect the fluid content of the container and to admit a predetermined calibrated quantity of neutralizing fluid sufficient to make a complete reaction possible. The drawback of acquiring a plurality of separate decontamination and neutralization chambers, each one requiring a complex arrangement of valves and conduits, is thereby overcome.

Furthermore, the amount of neutralizing fluid may be proportional to either the size and/or quantity of the filmemulsion carriers themselves, or it may be dependent upon a specified volume of the fluid contents within the container. This feature of the present invention assures that the appropriate amount of neutralization fluid will always be admitted into the container, and thereby overcomes the potential incomplete reaction drawback of the prior art.

An additional feature of the present invention is that the discharge means may be such as to discharge the neutralized contents of the container only after neutralization has been completed. In this way, premature dumping is eliminated.

The novel features which are considered as characteristic for the invention are set forth in particular in the appended claims. The invention itself, however, both as to its construction and is method of operation, together with additional objects and advantages thereof, will be best understood from the following description of specific embodiments when read in connection with the accompanying drawing.

DESCRIPTION OF THE PREFERRED EMBODIMENTS

Figures 1, 2:
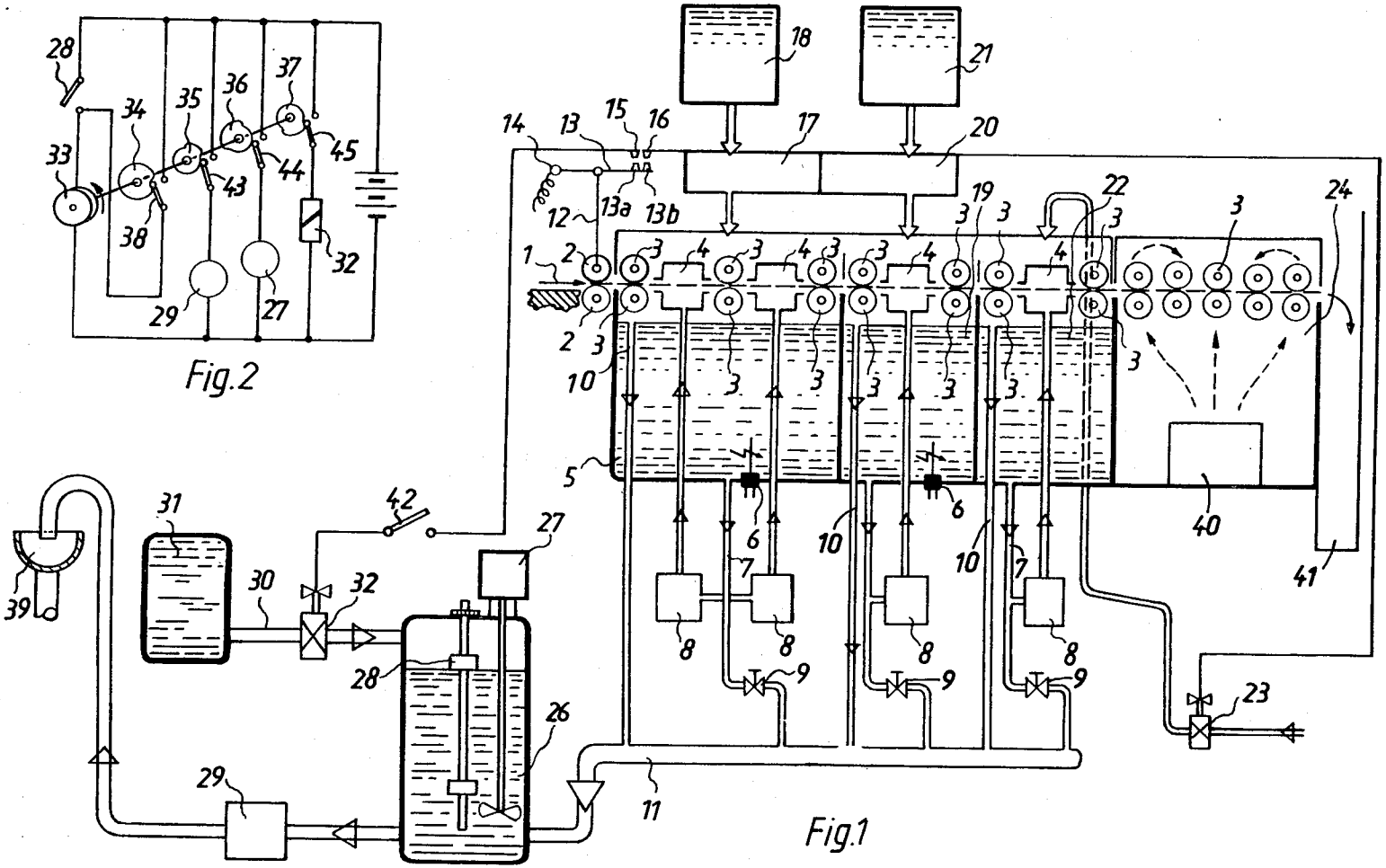
FIG. 1 is a diagrammatic view of an apparatus according to the present invention showing the plurality of work stations.
FIG. 2 is a diagrammatic view of a timing circuit cooperating with the apparatus of FIG. 1.

Discussing jointly the apparatus and the method which has been illustrated in an exemplary embodiment in FIGS. 1 and 2, it will be seen that reference numeral 1 indicates a a film-emulsion carrier which is conducted in a path as indicated by the arrow at 1 along which a plurality of work stations 5, 19, 22 are successively located. The film carrier 1 is sequentially conducted and respectively processed to each of the work stations 5, 19, 22 by means of the transporting means 3, such as the sets of friction nip rollers located on opposite sides and along the path. Each working station 5, 19, 22 has at least one working chamber 4 in which an individual film emulsion carrier 1 receives the respective film-processing fluid and which processes the film-emulsion carrier 1 in a manner known in the art as taught by German patent application Ser. No. P. 19 62 422.7-51.

Work station 5, which is located upstream of work stations 19 and 22, is the first film-processing station and contains a quantity of developer fluid, a chemical mixture well known in the art for developing film which is essentially basic as measured on the pH scale and is heated by the heater 6 and regulated by the thermostat (at 6) so as to maintain a constant working temperature well known in the art of photography.

The developer fluid is transmitted to a pair of working chambers 4 and circulated so as to achieve a working concentration by means of the intake conduit 7 located near the bottom region of the work station 5. The developer fluid is conducted through conduit 7 under pressure caused by the pair of rotating pumps 8. A valve 9 is provided in the intake conduit 7 to permit the option of allowing the developer fluid to be circulated through the pump 8 to the chambers 4, or alternatively, to permit all of the developer fluid to be drained into the accumulator pipe 11 in case an entire renewal of the developer fluid is desired.

Leveling means 10, shown as the pipe 10, prevents the rise of the developer fluid above the height of the pipe 10, and thereby serves to keep the fluid level constant inside the work station 5. The pipe 10 is directly connected to the accumulator pipe 11, so that any overflow of fluid in excess of said height may be discharged directly thereto.

The work station 19 is located downstream of work station 5 and contains fixer fluid, a chemical mixture well known in the art of photography and essentially acidic in character as measured on the pH scale. As with work station 5, a heater 6 with its associated thermostat (at 6) are provided to maintain the appropriate reaction temperature needed to insure that the fixing will occur properly. Only one chamber 4 is provided which receives the film-carrier 1 already processed by the set of chambers 4 of the work station 5. It will be understood that more than one chamber 4 could also be provided.

An intake conduit 7 is provided near the bottom region of working station 19 to cooperate with the single pump 8 and the valve 9 in like manner as described in the operation of work station 5.

Leveling means 10 serve a similar function as previously discussed by preventing the rise of fixer fluid above the height of the pipe 10 and directing any overflow of fixer fluid towards the accumulator pipe 11.

The work station 22 is located downstream of work station 19 and contains cleaning fluid, such as fresh water. The cleaning fluid is circulated to a working chamber 4 provided within work station 22 by means of the pump 8 via the intake conduit 7 which is again located in the lower region of the work station 22. Transporting nip rollers 3 and leveling means 10 serve the same function as previously described with connection to work stations 5 and 19.

Downstream of said work stations 5, 19, 22, a dryer 40 is located which dries each of the already processed film-emulsion carriers 1. Thereupon, the processed film is transported by means of the transporting rollers 3 to a waiting station 41.

Each of the work stations 5, 19, 22 is supplied with a fresh supply of respective film-processing fluid; i.e., work station 5 receives fresh fluid from supply source 18 which contains highly concentrated developer fluid; work station 19 receives fresh fluid from supply 21 which contains highly concentrated fixer fluid; and work station 22 receives fresh cleaning fluid from a separate source (not illustrated). Furthermore, work stations 5, 19, 22 are individually regulated by the respective regulation means 17, 20, 23, so that the amount of the fresh fluid can be metered out as a function of the size, length and/or the quantity of the film-emulsion carriers 1 to be processed.

A pair of nip rollers 2 are provided on opposite sides of the path upstream of work station 5 to initially engage and guide individual film-emulsion carriers 1 downstream towards work station 5. One of the rollers, e.g., the upper roller in FIG. 1, is movable with respect to the other roller and is fixedly connected and operative to engage the contacts of an electrical switch.

In operation, as a film-emulsion carrier 1 initially engages the nip of the drawing rollers 2, the upper roller will move upwards and transmit the vertically acting force by means of the connection between the connecting rod 12 and the electrically-conductive lever arm 13 which pivots about the pivot axis 14. One end of the lever arm (at 14) is connected to a source of electrical energy (not illustrated), and the other end is provided with contacts **13*a* and 13*b*. The described pivoting movement causes contacts 15 and 16 to be contacted by contacts 13*a* and 13*b*, respectively; this causes two electrical circuits to be simultaneously completed and two electrical signals to be generated. It should be understood that the duration of the completion of the circuits is directly dependent upon the size, length and/or the quantity of the film-emulsion carriers 1, since the upper roller of the set 2 will reassume its original position after an individual film carrier has left the nip of the drawing rollers 2 and been conveyed in the direction of 1**.

The electrical signal created by the closing of the contact **13*b* with the contact 16 is thereupon directed to the regulator 17, 20, 23 so as to successively energize valves provided respectively therein so as to meter the flow of the respective fluids into each of the work stations 5, 19, 22. It will be understood that the supply of fluid in supplies 18 and 21 are more concentrated than the working supply found within the working chambers 4. This is required so that the dilution that necessarily occurs within each respective work station can be accounted for in advance and that the proper potency of the fluid will be delivered to each of the chambers 4**.

For the cleaning fluid supply, a supply of fresh pure water is generally used which may be admitted into the working station 22 by means of the electrical signal energizing the valve 23 or with the aid of purely mechanical means independent of any electrical signal.

The waste fluids discharged from the work stations 5, 19, 22 through the pipes 10, or the conduit 7 by means of the open valve 9 in case an entire renewal of the fluid inside the working stations is desired, is accumulated in the accumulator pipe 11 and delivered to the container 26 for neutralization purposes.

The container 26 is provided with means for mixing its contents, such as the stirring motor 27 having a propeller-type blade at the end of its rotor. Sensor means 28 including a switch are provided within the container 26 to detect the level of the fluid contents within the container.

In operation, whenever the level of the fluid contents reaches a predetermined value, the switch of the sensor means 28 is closed, thus completing an electrical circuit. As will be explained in greater detail below, this is a triggering event for admitting neutralizing fluid by means of the valve 32, for actuating the motor 27, and for discharging the contents of the container 26.

A supply of neutralizing fluid 31 is provided in a separate container and is conducted via the inlet 30 and the electronically controlled valve 32 into the container 26. There are at least two modes of operation for the valve 32, since it is operative to admit neutralizing fluid by being actuated by the electrical signal created by the closing of the contact 13*a* with the contact 15 and/or by a timing circuit which is triggered by the switch of the sensor means 28. Either mode may be individually or in combination chosen by means of the switch 42. Opening the switch 42 will prevent the electrical signal generated from the contact 15 from reaching the valve 32.

The timing means, as shown in greater detail in FIG. 2, is an electrical circuit with four parallel paths, each performing a separate function. A means for rotating 33, such as a steering motor having a common shaft is provided with a plurality of cams 34 through 37, each fixedly connected with and longitudinally spaced along the axis of the shaft and each having a contoured surface which is adapted to close corresponding electrical switches 34, 43, 44, 45.

During the intended operation, when the switch 28 of the sensor means closes, i.e., when the fluid content within the container 26 reaches the level shown in FIG. 1, the motor 33 is immediately energized and starts to rotate at a reduced speed through a set of speed-reducing gears, for example, in a counterclockwise direction as shown by the arrow near the motor 33 for a time period which is at least sufficiently long to prevent the neutralization reaction to be completed.

As the shaft of the motor 33 rotates, each one of the cams respectively engages its respective switch. Cam 34 is among the first to engage its respective switch 38. The function of the switch 38 is to provide an alternative path for an electrical signal to pass through so that the motor 33 can complete a full rotation even though the fluid level height within the container 26 is subsequently decreased. In other words, even though the contents of the container 26 is discharged by means of the pump 29 which, in turn, causes the switch 28 to open, the motor 33 will nevertheless complete its cycle due to the fact that the holding switch 38 holds the switch 38 down and keeps the motor 33 energized until the original starting point is reached after one full cycle.

At the same time, or slightly after the switch 38 has been actuated, the cam 37 is operative to engage its respective switch 45 so as to energize the valve 32 and allow a predetermined quantity of neutralizing fluid to enter the container 26. The time interval for which the cam 37 engages the switch 45 is dependent upon the mode of operation of the apparatus as will be explained below.

Thereupon, the cam 36 will engage its respective switch 44. This cam is operative to energize the motor 27 to cause the mixture of waste fluid and neutralizing fluid to be intermixed causing the neutralization reaction to be completed. The time duration for which the cam 36 holds the switch 44 down is generally on the order of 10 seconds so as to insure a complete reaction.

The cam 35 is among the last of the cams to be engaged and it is operative to engage its respective switch 43. The function of the switch 43 is to energize the discharge means, or more specifically the pump 29 which is provided near the bottom portion of the container 26 to pump out the contents of the container 26 to a discharge area 39. The time interval for which the pump 29 is operative is generally calibrated to be the time it takes the fluid to get to the bottom of the tank. Of course, such considerations depend upon the size of the container and the working efficiency and capacity of the pump 29.

Toward the end of the cycle, the cam 34 is provided with a notch on its contoured surface so that the switch 38 will be disengaged from its circuit and thereby deactuate the steering motor 33, since the switch 28 has already been deactuated by the fall of the level of the fluid within the container. At this time, the apparatus is ready for another cycle.

It will be understood that there are several modes of operation for the apparatus according to the present invention. In a "combined" mode of operation, (i.e. switch 42 is closed) each film carrier 1 causes an electrical signal to be generated by the closing of the contacts 13*a* and 15; thereby repeatedly opening and closing the valve 32. This admits a proportional amount of neutralizing fluid into the container 26 as a function of the size and/or length and/or quantity of the film-emulsion carriers 1 to be processed through the apparatus. Evidently, as the number or size of the carriers increases, the amount of admitted neutralizing fluid increases proportionally.

When the waste fluids are eventually discharged into the container 26, a metered amount of neutralizing fluid will already be present within the container 26 so that the neutralization reaction may proceed. Only when the level of the mixture of waste fluids combined with the already present neutralizing fluids reaches a predetermined height will the switch of the sensor means 28 be actuated to begin the timing sequence described above. In other words, an additional amount of neutralizing fluid will be admitted into the container 26, so that when the motor 27 is actuated, a uniformly intermixed reaction can be assured. Finally, the discharge operation is actuated by means of the pump 29 which pumps the neutralized contents of the container 26 to the discharge area 39.

Furthermore, another mode of operation is possible with the present apparatus. If the switch 42 is opened to disconnect the electrical signal from the circuit 15, the apparatus may be operative solely by the timing circuit shown in FIG. 2. In this case, as each film-carrier 1 is conducted through the nip rollers 2, no neutralizing fluid will be admitted each time a film carrier 1 engages the nip of the drawing rollers 2. The waste fluids which are discharged to the accumulator pipe 11 and admitted into the container 26 will eventually approach the level which actuates the switch of the sensor means 28, and the previously described cycle of the timing circuit will repeat itself.

It will be appreciated that in this mode of operation, the quantity of neutralizing fluid admitted by the valve 32 will be greater than in the first discussed mode of operation. In other words, in the first described mode of operation, many separate smaller admissions of neutralizing fluid are admitted into the container 26 and are followed by another admission just prior to the operation of the motor 27; whereas, in the second described mode of operation, the quantity of neutralizing fluid should be an amount sufficient to at least constitute the sum of the many separate smaller admissions.

The switch 42 may be operated manually or automatically and by electrical or mechanical means as desired.

The neutralizing fluid stored within the container 31 is any oxygen-delivering agent, i.e., any bleaching agent such as acetic acid, sodium hypochloride, or hydrogen peroxide.

While the invention has been illustrated and described as embodied in an apparatus and method for neutralizing waste photographic fluids, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of developing film in a photographic wet-type apparatus having a plurality of work stations containing film-processing fluids, comprising the first step of admitting waste fluids discharged from said work stations, which fluids require neutralization, to a container adapted to receive said waste fluids; the second step of detecting the fluid contents within said container and generating an electrical signal in dependence upon the detected fluid content of said container; the third step of admitting a predetermined quantity of neutralizing fluid from a separate supply into said container by means of a valve controlled by said electrical signal: and the fourth step of discharging the fluid contents of said container after neutralization has occurred.

2. In a photographic apparatus for processing films or analogous sheet-or web-like carriers of photosensitive material, a combination, comprising a plurality of work stations each containing a supply of a processing fluid; means for transporting carriers through respective ones of said work stations so as to be processed by the processing fluids therein, whereby the latter become spent; means for discharging spent processing fluids from the respective work stations; a container adapted to receive said spent processing fluids which are discharged from said work stations and which require neutralization; a supply of neutralizing fluid; and control means for admitting a predetermined quantity of said neutralizing fluid into said container from said supply of neutralizing fluid as a function of the quantity of carriers transported through said work stations.

3. In a photographic wet-type film developing apparatus having a plurality of work stations containing film-processing fluids, a combination comprising a container adapted to receive waste fluids discharged from said work stations and requiring neutralization; a supply of neutralizing fluid for said waste fluids; sensor means associated with said container for detecting the fluid content admitted into said container and generating an electrical signal in dependence upon the detected fluid content; control means operative to cooperate with said sensor means for admitting a predetermined quantity of neutralizing fluid from said supply into said container, said control means comprising an electronically-controlled valve associated with said supply of neutralizing fluid and adapted to admit a predetermined quantity of neutralizing fluid into said container in dependence upon said electrical signal; and discharge means for discharging the contents of said container after being neutralized.

4. A photographic apparatus as defined in claim 3, wherein said work stations are successively located in a path through which a plurality of film-emulsion carriers are sequentially conducted and respectively processed with said film-processing fluids.

5. A photographic apparatus as defined in claim 4; and further comprising transporting roller means including a pair of drawing nip rollers positioned on mutually opposite sides of said path upstream of said work stations for guiding an individual film-emulsion carrier along said path, one of said rollers being displaceable with respect to the other.

6. A photographic apparatus as defined in claim 4, wherein one of said work stations contains developer fluid and is located upstream of the remaining work stations; wherein a second one of said work stations contains fixer fluid and is located downstream of said one work station; wherein a third one of said work stations contains a cleaning fluid and is located downstream of said second work station; and further comprising a dryer located downstream of said work stations which contain said film-processing fluids and adapted to dry said processed film-emulsion carriers.

7. A photographic apparatus as defined in claim 4, wherein each of said work stations comprises inlet means for conducting a fresh concentrated supply of film-processing fluid into said respective work stations, regulator means cooperating with said inlet means for regulating the quantity of fresh concentrated processing fluid to be admitted into said respective work stations, at least one working chamber provided within each of said stations, circulating means for circulating the film-processing fluid to achieve a uniform working concentration for eventual delivery to said working chambers, transporting means for transporting said plurality of film-emulsion carriers downstream through said respective working chambers in said path, leveling means for leveling the height of said film-processing fluids within said stations, and drainage means including an accummulator pipe for accumulating all waste film-processing fluids in excess of said height and discharging the latter into said container.

8. A photographic apparatus as defined in claim 3, wherein said discharge means includes a pump located near the bottom region of said container for discharging the neutralized contents therein; and further comprising means for stirring the contents of said container so that said waste fluids and said predetermined quantity of neutralizing fluid can be uniformly intermixed.

9. A photographic apparatus as defined in claim 3, wherein said supply of neutralizing fluid is an oxygen-releasing bleaching-agent of the group composed of acetic acid and sodium hypochloride and hydrogen peroxide.

10. In a photographic wet-type film developing apparatus having a plurality of work stations successively located in a path through which a plurality of film-emulsion carriers are sequentially conducted, each of said work stations containing film-processing fluids for respectively processing said film-emulsion carriers, a combination comprising transporting roller means including a pair of drawing nip rollers positioned on mutually opposite sides of said path upstream of said work stations for guiding an individual film-emulsion carrier along said path, one of said rollers being displaceable with respect to the other; a container adapted to receive waste fluids discharged from said work stations and requiring neutralization; a supply of neutralizing fluid for said waste fluids; sensor means associated with said container for detecting the fluid content admitted into said container; control means operative to cooperate with said sensor means for admitting a predetermined quantity of neutralizing fluid from said supply into said container in dependence upon the detected fluid content, said control means comprising a valve associated with said supply of neutralizing fluid and adapted to admit a predetermined quantity of neutralizing fluid into said container in dependence upon an electrical signal, said control means further comprising a displaceable member and electric switch means, said displaceable member being connected to said displaceable roller and operative to generate said electrical signal to open said valve by closing said switch means each time a film-emulsion carrier engages the nip of said drawing rollers and to close said valve each time the same film-emulsion carrier is disengaged from said nip; and discharge means for discharging the contents of said container after being neutralized.

11. A photographic apparatus as defined in claim 10, wherein said predetermined quantity of neutralizing fluid includes at least the sum of the series of the individual admissions admitted into said container caused by the successive generations of said electrical signal, said predetermined quantity of neutralizing fluid being proportionally dependent upon the respective time intervals that it takes for each film-emulsion carrier to pass through said nip.

12. In a photographic wet-type film developing apparatus having a plurality of work stations containing film-processing fluids, a combination comprising a container adapted to receive waste fluids discharged from said work stations and requiring neutralization; a supply of neutralizing fluid for said waste fluids; sensor means associated with said container for detecting the fluid content admitted into said container; control means operative to cooperate with said sensor means for admitting a predetermined quantity of neutralizing fluid from said supply into said container in dependence upon the detected fluid content, said control means comprising timing means associated with said sensor means and including a common shaft, a plurality of cams provided on said shaft, steering means for rotating said shaft, and a plurality of electrical switch means, each cooperating with said respective cams to complete a plurality of electrical paths; and discharge means for discharging the contents of said container after being neutralized.

13. A photographic apparatus as defined in claim 12, wherein said control means further comprises a valve associated with said supply of neutralizing fluid and adapted to admit a predetermined quantity of neutralizing fluid into said container in dependence upon an electrical signal.

14. A photographic apparatus as defined in claim 12, wherein said sensor means detects the fluid content of said container by comparing the fluid level height of the contents therein with a predetermined height level so that when said level is reached said sensor means actuates said steering means which rotates said cams which are fixedly connected with and longitudinally spaced along said shaft, said cams having a contoured surface portion to respectively engage said switch means.

15. A photographic apparatus as defined in claim 12, wherein one of said cams is operative to complete an electrical path which is a bypass path for the electrical current passing through said sensor means, so that said steering means may perform a complete rotation even though said fluid level height varies due to the subsequent operation of said discharge means.

16. A photographic apparatus as defined in claim 12, wherein one of said cams is operative to complete an electrical path which serves to energize said discharge means after the neutralization reaction has been completed.

17. A photographic apparatus as defined in claim 12, wherein said work stations are successively located in a path through which a plurality of film-emulsion carriers are sequentially conducted and respectively processed with said film-processing fluids; and wherein said control means comprises a valve associated with said supply of neutralizing fluid and adapted to admit a predetermined quantity of neutralizing fluid into said container in dependence upon an electrical signal; and wherein said discharge means includes a pump located near the bottom region of said container for discharging the neutralized contents therein; and further comprising means for stirring the contents of said container so that said waste fluids and said predetermined quantity of neutralizing fluid can be uniformly intermixed.

18. A photographic apparatus as defined in claim 17, wherein said predetermined quantity of neutralizing fluid includes an additional quantity of neutralizing fluid, and wherein one of said cams is operative to complete an electrical path so as to generate an electrical signal to actuate said valve and admit said additional quantity into said container.

19. A photographic apparatus as defined in claim 17, wherein one of said cams is operative to complete an electrical path which serves to energize said stirring means so as to aid the neutralization reaction.

* * * * *